United States Patent [19]

Rich

[11] 4,176,789

[45] Dec. 4, 1979

[54] RAILROAD GRADE CROSSING PLATFORM AND AN END CAPPING DEVICE THEREFOR

[75] Inventor: Brett Rich, Malad City, Id.

[73] Assignee: Industrial Sales & Marketing Corporation, Malad City, Id.

[21] Appl. No.: 820,728

[22] Filed: Aug. 1, 1977

[51] Int. Cl.[2] ..... E01B 21/00

[52] U.S. Cl. ..... 238/8; 238/6; 238/9

[58] Field of Search ..... 238/2, 8, 9, 6

[56] References Cited

U.S. PATENT DOCUMENTS

| | | | |
|---|---|---|---|
| 1,055,442 | 3/1913 | Browne | 238/8 |
| 1,279,062 | 9/1918 | Winter | 238/8 |
| 1,658,444 | 2/1928 | King | 238/8 |
| 2,839,249 | 6/1958 | Curtis | 238/8 |
| 3,487,998 | 1/1970 | Farmer | 238/8 |

OTHER PUBLICATIONS

Railway Track and Structures, May 1976, pp. 34 & 35.

*Primary Examiner*—Trygve M. Blix
*Assistant Examiner*—Ross Weaver
*Attorney, Agent, or Firm*—Mallinckrodt & Mallinckrodt

[57] ABSTRACT

The exposed ends of railroad grade crossing platforms are protectively capped with elongate devices which provide ramps sloping downwardly and away from the surface of the platforms along the ends of the grade crossing. The ramps deflect air hoses, chains, etc. which occasionally hang downwardly from railroad cars and locomotives passing over the grade crossing, and, thus, prevent the free ends of such items from being caught on or damaged by the otherwise exposed ends of the grade crossing platforms. Ramp-supporting members extend in mutually spaced relationship from the underside of the ramp of each device so that in end view, the device has the shape of essentially a right triangle, whose hypotenuse is on the ramp surface and whose legs are partially formed by the respective supporting members and partially by the ramp. The opposite legs of the triangular shape are preferably unequal in length so that the cap devices can accommodate two different platform heights. The cap devices are secured in place in the crossing by spikes driven through the sloping ramp surfaces thereof and into the ties in the bed of the railroad track.

3 Claims, 9 Drawing Figures

RAILROAD GRADE CROSSING PLATFORM AND AN END CAPPING DEVICE THEREFOR

BACKGROUND OF THE INVENTION

1. Field

The invention pertains to grade crossings of railroad tracks, and, more particularly, to grade crossings comprising flat platform sections which are positioned between adjacent rails of the crossing and along the mutually opposite outer-sides of the outside rails of the crossing.

2. State of the Art

Grade crossings across railroad tracks have commonly been formed from gravel, asphalt aggregate, etc. to form a fill between adjacent rails. In such applications some type barrier must be used adjacent to the inside of the rails on each track to provide an open space along the inside of the rails to accommodate the flanges on the wheels of a train. Recently, improvements in grade crossings have been accomplished by providing rigid platform sections which are attached to the upper surface of the ties of the track and provide a flat surface substantially level with the top of the rails. The rigid platforms are installed quickly to provide a smooth crossing requiring essentially no maintenance for long periods of time. Despite their advantages, the platform crossings have heretofore had one serious drawback. The exposed ends of the platforms at the sides of the crossing are subject to being damaged by loose air hoses, chains, etc. hanging from passing trains, and the hoses, chains, etc. on the passing trains are, in turn, subject to being damaged by hitting and catching on the bluff end of the crossing.

OBJECTIVE

A principal objective of this invention was to develop a reliable, inexpensive system for preventing damage to the loose hoses, etc. hanging from passing trains as well as preventing damage to the platform sections of the grade crossing.

SUMMARY OF THE INVENTION

In accordance with the invention, the foregoing objective is achieved by providing elongate, protective cap devices for the exposed ends of the platform sections of a grade crossing. The cap devices each include a ramp whose width extends longitudinally thereof. Ramp-supporting members extend in mutually spaced relationship from the underside of the ramp substantially normal to the ramp surface. In end view, the device has the shape of essentially a right triangle, with the ramp forming the hypotenuse and the ramp-supporting members the other two sides of the triangle.

Means are provided for securing the cap devices to the track ties adjacent to the otherwise exposed ends of platform sections in the grade crossing. In particular, each cap device is adapted to be secured to a tie in the railroad bed by spikes driven through the ramp surface and into the tie. One of the longitudinal sides of the device engages the upper surface of the railway tie, the other corresponding side abuts the bluff end of the platform, and the ramp portion is exposed as an inclined end for the grade crossing, sloping from the top surface of the otherwise exposed end of the crossing platform downwardly to the level of the ties in the railroad bed.

The cap devices provide protection to the bluff ends of the platform sections from air hoses, chains, etc. which occasionally hang downwardly from railroad cars and locomotives which pass over the grade crossing. In addition, the inclined ramp section of the devices deflect the ends of such hoses, chains, etc. preventing the free ends of such items from being caught on or damaged by the otherwise exposed ends of the platform sections.

THE DRAWINGS

The best mode presently contemplated of carrying out the invention is illustrated in the accompanying drawings, in which:

FIG. 1 is a perspective view showing a railroad grade crossing conforming to the invention;

FIG. 2, a cross-sectional view taken along line 2—2 of FIG. 1;

FIG. 3, an enlarged, fragmentary, cross-sectional view through the end of a railroad grade crossing along line 3—3 of FIG. 1, wherein the height of the rail is substantially the same as the shorter of the sides of the capping device;

FIG. 4, an enlarged, fragmentary, cross-sectional view similar to that of FIG. 3, but taken through the other end of a crossing of railroad tracks in which the height of the rails is greater than that of the rails of FIGS. 1-3 and substantially the same as the longer of the sides of the capping device;

FIG. 5, a top plan view of a cap device in accordance with the invention which has a length substantially equivalent to the length of the tie ends that project beyond the rails of the railroad grade crossing;

FIG. 6, an end elevation view of the cap member of FIG. 5;

FIG. 7, a front elevation view of the cap member of FIG. 5;

FIG. 8, a bottom plan view of the cap member of FIG. 5; and

FIG. 9, a bottom plan view of a cap device in accordance with the invention which has a length substantially equivalent to the spacing between the rails of the railroad grade crossing.

DETAILED DESCRIPTION OF THE ILLUSTRATED EMBODIMENT

Figure 1:
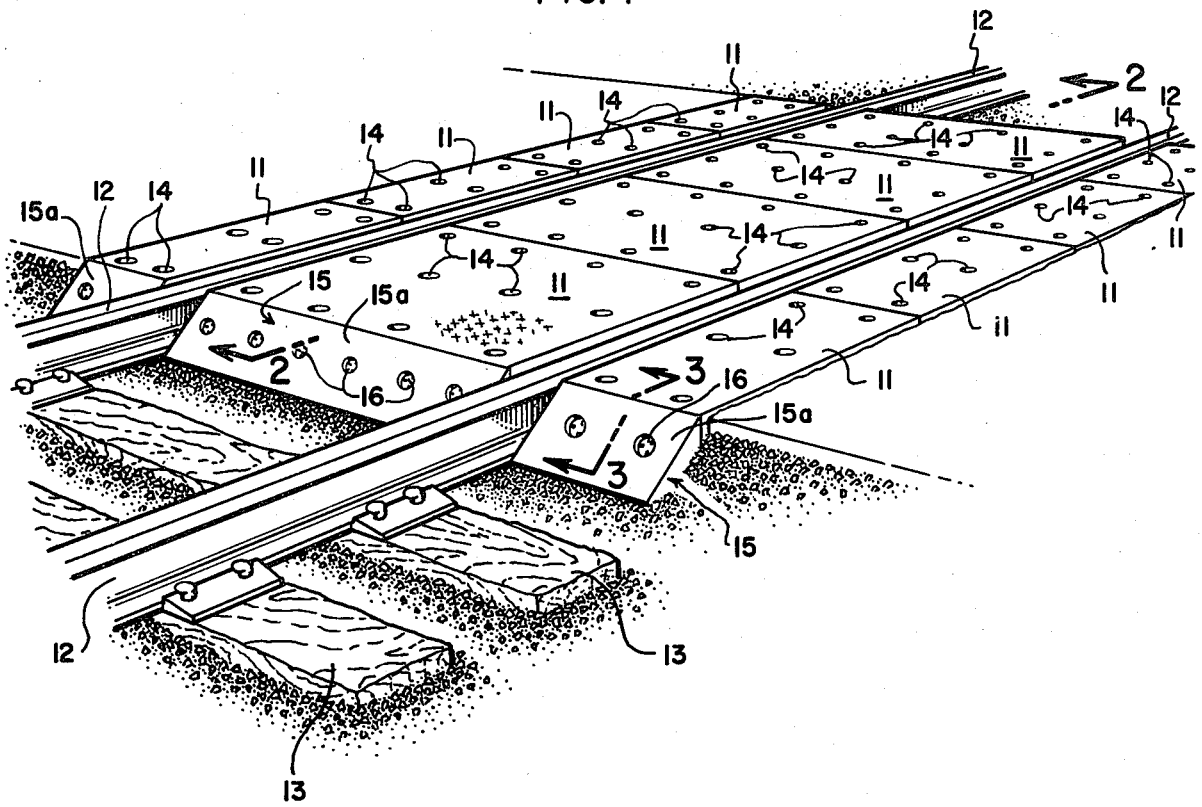
Figure 2:
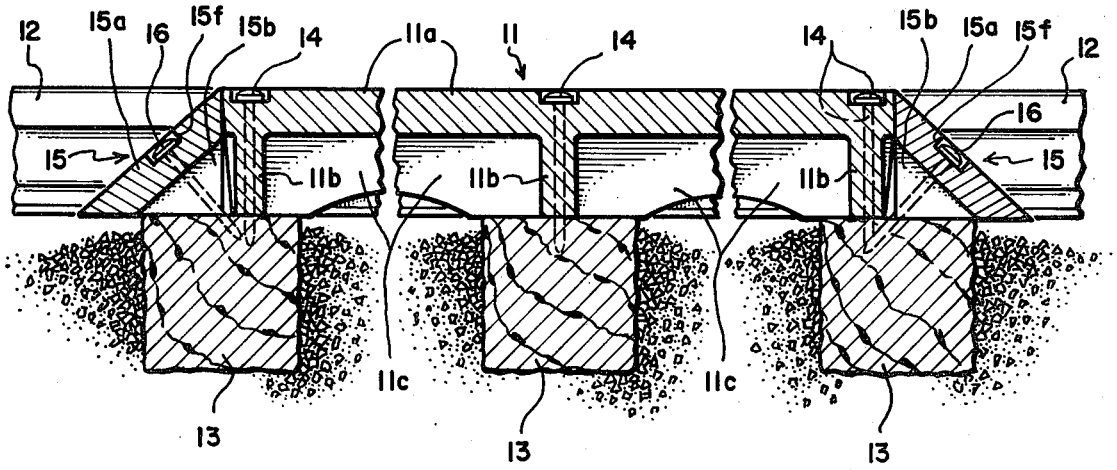
Figure 3:
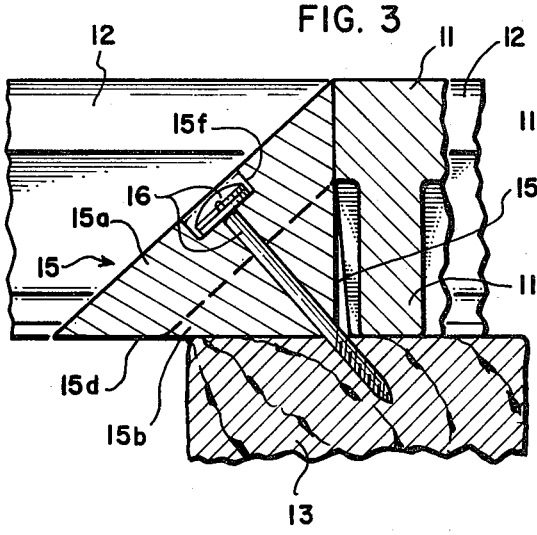

In accordance with the present invention, an improved railroad grade crossing, as shown in FIGS. 1-3, comprises a plurality of rigid platform sections 11 which are positioned between adjacent rails 12 of the crossing and along the mutually opposite, outer-sides of the outside rails of the crossing. The rigid platform sections 11 customarily comprise a substantially flat upper tread plate **11*a* as shown in FIGS. 2 and 3 which provide a flat surface substantially level with the top of the rails 12. The tread plate 11*a* is supported by appropriate support elements such as the uniformly spaced legs 11*b* and interconnecting support spars 11*c* as shown in FIGS. 2 and 3. The platform sections 11 are secured to the ties 13 in the bed of the railroad by spikes 14 driven through the surface of the sections 11 into ties 13**.

Figure 9:
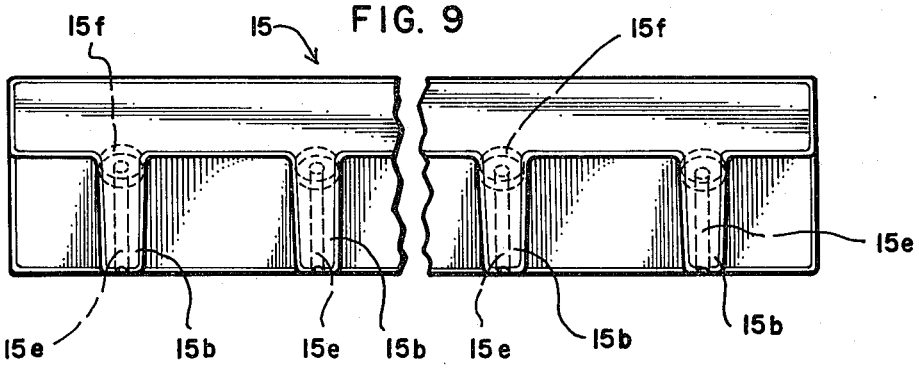

The bluff ends of the platform sections 13 at the ends of the crossing are capped with elongate devices 15 in accordance with this invention. The devices 15 preferably are made of two different longitudinal lengths. The shorter devices 15 are used on the outer-sides of the rails 12 in the grade crossing and have lengths substantially equivalent to the lengths of the tie ends that project beyond the outer rails of the railroad grade crossing. The shorter devices 15 are shown in detail in FIGS. 5–8. The longer devices 15 are used between the rails 12 of the grade crossing and have lengths substantially equivalent to the spacing between the rails of the grade crossing. A bottom plan view of one of the longer devices 15 is shown in FIG. 9.

Figure 4:
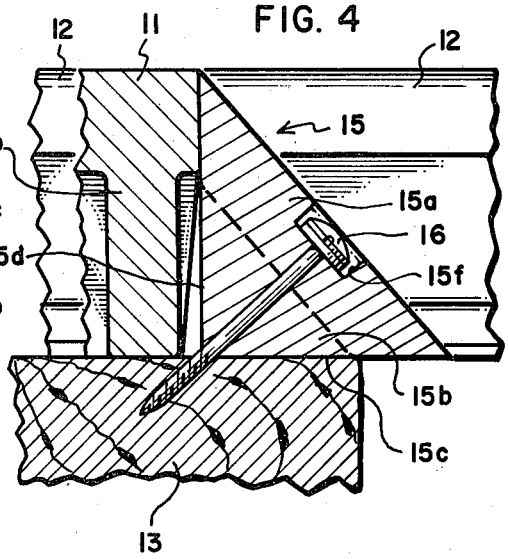
Figure 8:
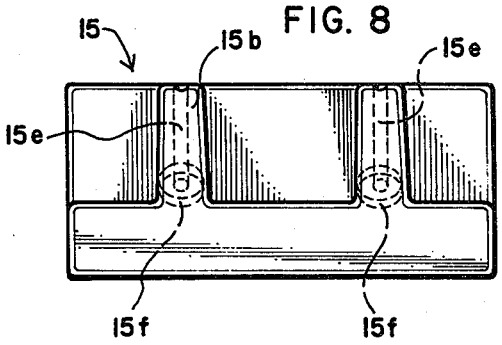
Figure 5:
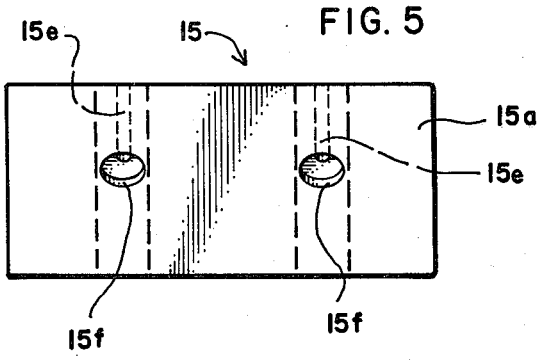
Figure 6:
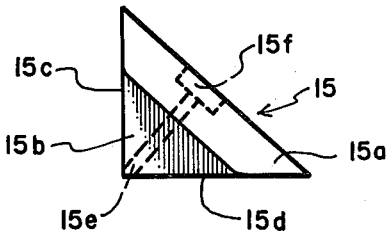
Figure 7:
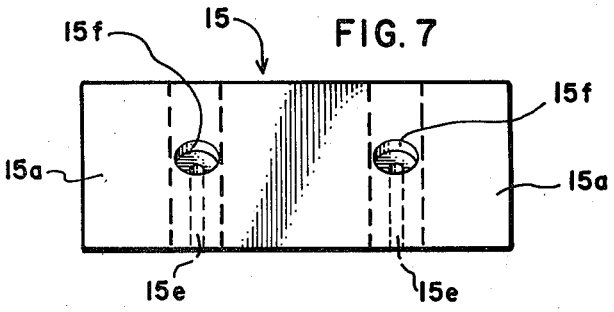

The devices 15, either the longer or the shorter, comprise a substantially flat, inclined ramp 15*a* whose width extends longitudinally of the device. Ramp-supporting members 15*b* are attached integrally to and extend in mutually spaced relationship from the underside of the ramp 15*a* substantially normal to the surface of the ramp 15*a*. The members 15*b* have free sides 15*c* and 15*d* which extend from mutually opposite, longitudinal sides of the ramp 15*a*, respectively (FIGS. 3, 4, and 6). As illustrated, the side 15*c* is shorter in its length than is side 15*d*, the purpose for such difference to be fully explained hereinafter. The sides 15*c* and 15*d* meet at a common edge, and the sides 15*c* and 15*d*, along with the ramp 15*a*, form substantially a right triangle whose hypotenuse is the ramp 15*a* and whose legs are formed by the respective sides 15*c* and 15*d* of the support members 15*b*. In the preferred embodiment as illustrated, the ramp 15*a* is made to have a substantial thickness, and its longitudinal sides are formed at an angle. The hypotenuse of the right triangular shape seen in the end views of FIGS. 2–4, and 6 is formed by the upper surface of ramp 15*a* and legs of the triangle are partially formed by the sides 15*c* and 15*d* of support members 15*b* and partially by the angled, longitudinal sides of ramp 15*a*.

Means are provided for securing the cap devices 15 to the railroad track ties 13 at the ends of the grade crossing. In the preferred form, passageways 15*e* extend through the support members 15*b* and enlarged recesses 15*f* are provided around the passageways 15*e* in the outer surface of ramp 15*a*. Spikes 16 (FIGS. 2–4) are driven through the passageways 15*e* into the ties 13. The spikes 16 are driven into the ties 13 until the heads on the spikes are received in and engage the recesses 15*f* of the cap devices 15.

As illustrated in FIGS. 1–4 the cap devices 15 are secured to ties 13 so that the ramp support members 15*b* engage the exposed ends of the platform sections 11 at the ends of the grade crossing and the upper surface of the ties 13 at the ends of the grade crossing, respectively. The ramp surfaces of the devices 15 are then left exposed as inclined ends for the otherwise exposed ends of the grade crossing platform sections 11.

As mentioned hereinbefore, the respective sides 15*c* and 15*d* of the support members 15*b* are of different lengths. This permits the cap devices to be used with either of two rail heights corresponding to the two different lengths of the sides 15*c* and 15*d*. In FIG. 3, the devices 15 are shown in use in a railroad grade crossing in which the height of the rails 12 in the track is substantially equivalent to the length of the shorter sides 15*c* of the devices 15. Thus, the longer sides 15*d* of the devices 15 are placed adjacent to and engaging the upper surfaces of the ties 13, and the shorter sides 15*c* abut the otherwise exposed ends of the platform sections 11 at the ends of the grade crossing. In FIG. 3, the devices are shown in use with rails 12 which have a height substantially equivalent to the length of the longer sides 15*d* of the devices 15. In such use, the shorter sides 15*c* of the devices 15 are placed adjacent to and engaging the upper surfaces of the ties 13, and the longer sides 15*d* abut the otherwise exposed ends of the platform sections 11 at the ends of the grade crossing. The two most common heights of rails are $6\frac{5}{8}$ inches and $7\frac{1}{2}$ inches, respectively. Thus, in a particularly advantageous embodiment, the shorter sides 15*c* of the devices 15 have a length of $6\frac{5}{8}$ inches, while the longer sides have a length of $7\frac{1}{2}$ inches.

Whereas this invention is here illustrated and described with respect to embodiments presently contemplated as the best mode of carrying out the invention in actual practice, it is to be understood that various changes may be made within the scope of the generic teachings hereof.

I claim:

1. An elongate device of right triangular formation in transverse cross-section for protectively capping an exposed end of a railroad grade crossing platform, said device comprising a substantially flat, inclined ramp member whose width extends longitudinally of the device and which has thickness beveled along its width to provide acute angled edges extending along said width at the ramp surface and flat surfaces extending backwardly therefrom as portions of the legs of the triangular formation; ramp-supporting members attached to and extending in mutually-spaced relationship from the underside of the ramp member intermediate its width and substantially normal to the ramp surface, said ramp-supporting members each, along with the ramp member, forming substantially a right triangle whose hypotenuse is on the ramp surface and whose legs are partially formed by the respective ramp-supporting members and partially by the ramp member; and means for securing said device to a railroad track tie at an end of the grade crossing platform so that the ramp-supporting members engage the grade crossing platform and the upper surface of said tie, respectively, with the ramp surface being exposed as an inclined end for said grade crossing platform, the legs of the triangular formation being of unequal lengths corresponding, respectively, to mutually different standard rail heights, so that the device can be used with either of two rail heights corresponding to said lengths.

2. A device in accordance with claim 1, wherein the length of the device is substantially equivalent to the spacing between the rails of the railroad grade crossing.

3. A device in accordance with claim 1, wherein the length of the device is substantially equivalent to the length of the tie ends that project beyond the rails of the railroad grade crossing.

* * * * *